US008643277B2

(12) United States Patent
Neate

(10) Patent No.: US 8,643,277 B2
(45) Date of Patent: Feb. 4, 2014

(54) LIGHT SOURCE

(75) Inventor: Andrew Simon Neate, Aylesbury (GB)

(73) Assignee: Ceravision Limited

( * ) Notice: Subject to any disclaimer, the term of this patent is extended or adjusted under 35 U.S.C. 154(b) by 122 days.

(21) Appl. No.: 13/383,473

(22) PCT Filed: Jul. 29, 2010

(86) PCT No.: PCT/GB2010/001439

§ 371 (c)(1),
(2), (4) Date: Mar. 6, 2012

(87) PCT Pub. No.: WO2011/015807

PCT Pub. Date: Feb. 10, 2011

(65) Prior Publication Data

US 2012/0153824 A1 Jun. 21, 2012

Related U.S. Application Data

(60) Provisional application No. 61/233,786, filed on Aug. 13, 2009.

(30) Foreign Application Priority Data

Aug. 5, 2009 (GB) ..... 0913691.2

(51) Int. Cl.
*H01J 65/04* (2006.01)

(52) U.S. Cl.
USPC ..... 315/34; 315/39; 315/39.3; 315/39.51; 315/111.21; 315/111.71

(58) Field of Classification Search
USPC ..... 315/34, 39, 39.3, 39.51, 39.55, 41, 44, 315/111.21, 111.71
See application file for complete search history.

(56) References Cited

U.S. PATENT DOCUMENTS

| | | | | |
|---|---|---|---|---|
| 4,001,632 | A | 1/1977 | Haugsjaa | |
| 4,041,352 | A * | 8/1977 | McNeill et al. | 315/248 |
| 5,834,895 | A * | 11/1998 | Dolan et al. | 313/570 |
| 2011/0285287 | A1 * | 11/2011 | Neate | 315/34 |

FOREIGN PATENT DOCUMENTS

| | | |
|---|---|---|
| GB | 2454666 | 5/2009 |
| WO | WO95/23426 | 8/1995 |
| WO | WO2006/129102 | 12/2006 |
| WO | WO2009/063205 | 5/2009 |

* cited by examiner

*Primary Examiner* — Douglas W Owens
*Assistant Examiner* — Thai Pham
(74) *Attorney, Agent, or Firm* — Jennifer Meredith, Esq.; Meredith & Keyhani, PLLC

(57) ABSTRACT

A light source is powered by a magnetron and has a quartz crucible having a plasma void with an excitable fill, from which light radiates in use. Two aluminum attachment blocks are attached together and the block is attached to a casing of the magnetron by screws—not shown. The quartz crucible is attached to the block by a Faraday cage, in the form of a perforate metal enclosure secured at its rim to the block. An output formation of the magnetron has a conductive, copper cap fitted in electrical contact with it. The cap is extended by a copper rod. The rod extends through the blocks into a bore in the crucible for coupling microwaves from the magnetron into the crucible. An airspace is provided around the cap in the block. From the cap, the rod extends with negligible air gap in an alumina ceramic tube through the airspace and a boss of the block located in an aperture in an end wall of the block.

12 Claims, 3 Drawing Sheets

LIGHT SOURCE

This application is a national stage under 35 U.S.C. 371 of International Application No. PCT/GB2010/001439 filed Jul. 29, 2010 which claims priority to and the benefit of United Kingdom patent application number 0913691.2 filed Aug. 5, 2009.

The present invention relates to a light source.

In U.S. Pat. No 6,737,809 there is described and claimed:

1. A lamp comprising:

(a) a waveguide having a body comprising a ceramic dielectric material of a preselected shape and preselected dimensions, the body having a first side determined by a first waveguide outer surface;

(b) a first microwave feed positioned within and in intimate contact with the waveguide body, adapted to couple microwave energy into the body from a microwave source having an output and an input and operating within a frequency range from about 0.5 to about 30 GHz at a preselected frequency and intensity, the feed connected to the source output, said frequency and intensity and said body shape and dimensions selected such that the body resonates in at least one resonant mode having at least one electric field maximum;

(c) an enclosed first cavity depending from said first surface into the waveguide body; and (d) a first bulb positioned in the cavity at a location corresponding to an electric field maximum during operation, the bulb containing a gas-fill which when receiving microwave energy from the resonating waveguide body forms a light-emitting plasma.

We name this lamp a ceramic waveguide lamp and have developed its technology and in particular have developed a matching circuit for matching the output impedance of a microwave source to the input impedance of the waveguide. This is described in our International Patent Application No PCT/GB2007/001935 ("the 1935 Application"). On entry to the UK national phase, under No GB 0820183.2 the main claim was amended as follows:

1. A lamp to be driven from a source of microwave energy, the lamp comprising:

an electrodeless, discharge bulb, a radiator for radiating microwave energy to the bulb, a bulb receptacle formed of ceramic material coated with an electrically conductive shield, the receptacle having:

a first recess containing the bulb, the recess being open to allow light to shine from the bulb and a second recess containing the radiator, with the second recess being open to allow connection of microwaves to the radiator and a microwave circuit having:

an input for microwave energy from the source thereof and an output connection thereof to the radiator in the ceramic receptacle, wherein the microwave circuit is a capacitative-inductive circuit configured as a bandpass filter and matching output impedance of the source of microwave energy to input impedance of the circuit, receptacle and bulb combination.

In our development of electrodeless bulbs in a waveguide, we have combined the lamp and the waveguide, allowing the light to radiate through the waveguide. This development is the subject of our International Patent Application No. PCT/GB2008/003829. This describes and claims:

1. A light source to be powered by microwave energy, the source having:

a solid plasma crucible of material which is lucent for exit of light therefrom, the plasma crucible having a sealed void in the plasma crucible, a Faraday cage surrounding the plasma crucible, the cage being at least partially light transmitting for light exit from the plasma crucible, whilst being microwave enclosing, a fill in the void of material excitable by microwave energy to form a light emitting plasma therein, and an antenna arranged within the plasma crucible for transmitting plasma-inducing microwave energy to the fill, the antenna having:

a connection extending outside the plasma crucible for coupling to a source of microwave energy;

the arrangement being such that light from a plasma in the void can pass through the plasma crucible and radiate from it via the cage.

For understanding of this light source, we use the following definitions:

"lucent" means that the material, of which the item described as lucent, is transparent or translucent;

"plasma crucible" means a closed body enclosing a plasma, the plasma being in the void when the latter's fill is excited by microwave energy from the antenna.

We name this light source an LER.

We noted a significant difference between a ceramic waveguide lamp using an electrodeless bulb inserted in the waveguide and an LER. In the former, there is a change of input impedance of the waveguide between start-up and steady state operation. This causes a mismatch of impedance with the output impedance of the microwave source driving the lamp. This mismatch is accommodated in the bandpass matching circuit of our 1935 Application, enabling it to pass microwave energy both on start up on during normal operation. (We are not fully confident that we understand the reason for this impedance change, but we believe it to be associated with the capacitive gap between the bulb and the waveguide in a ceramic waveguide lamp.) In the case of the LER there is no such change in input impedance. Indeed we were surprised to note that the input impedance of the LER remains substantially constant between start-up and normal operation.

In our patent application No 0907947.6, we described a light source to be powered by microwave energy, the source having:

a solid plasma crucible of material which is lucent for exit of light therefrom, the plasma crucible having a sealed void in the plasma crucible, a Faraday cage surrounding the plasma crucible, the cage being at least partially light transmitting for light exit from the plasma crucible, whilst being microwave enclosing, a fill in the void of material excitable by microwave energy to form a light emitting plasma therein, and an antenna arranged within the plasma crucible for transmitting plasma-inducing microwave energy to the fill, the antenna having:

a connection extending outside the plasma crucible for coupling to a source of microwave energy;

the light source also including:

a generator of microwaves at a frequency to excite resonance within the lucent crucible and the Faraday cage for excitation of a light emitting plasma in the sealed void and a waveguide for coupling microwaves from the generator to the antenna, the waveguide being substantially two or more half wave lengths long and having:

an output from the generator positioned at one quarter wavelength from its input end and an input to the antenna connection positioned at one quarter wavelength from its output end.

We have now developed an alternative to the waveguide for coupling the microwaves from the generator to the antenna, in that we have determined that the wave guide can be substituted by a coaxial connection between the generator and the antenna.

Thus according to the present invention there is provided a light source to be powered by microwave energy, the source having:

a solid plasma crucible of material which is lucent for exit of light therefrom, the lucent crucible having a sealed void therein;

a microwave-enclosing Faraday cage surrounding the lucent crucible, the cage being at least partially light transmitting for light exit therethrough from the lucent crucible;

a fill in the void of material excitable by microwave energy to form a light emitting plasma therein;

an antenna arranged within the lucent crucible for transmitting plasma-inducing microwave energy to the fill, the antenna having:

a connection extending outside the lucent crucible for coupling to a source of microwave energy;

a generator of microwaves for excitation of a light emitting plasma in the sealed void, the generator having an output for microwaves;

means for attaching the generator to the lucent crucible, the attachment means having:

a passage with a conductive wall extending from the generator output to the antenna connection; and an electrical conductor passing along the passage from the output of the generator to the connection of the antenna, the conductor forming with the conductive passage a transmission line for microwave energy from the generator to the lucent crucible for excitation of the plasma therein.

Preferably the generator is adapted to generate microwaves at a frequency to excite resonance within the lucent crucible.

Preferably the Faraday cage and a chassis of the microwave generator are electrically connected together by the conductive wall of the passage. Normally, the cage, chassis and wall will all be earthed. In the preferred embodiment, the conductive wall is a bore in a metallic body connecting the Faraday cage & lucent crucible and the microwave generator.

Preferably the electrical conductor is co-axial with the bore, being held in the centre of the bore by a spacer. Conveniently the spacer is of solid dielectric material, in the preferred embodiment, alumina ceramic:

To help understanding of the invention, a specific embodiment thereof will now be described by way of example and with reference to the accompanying drawings, in which.

Figure 1:
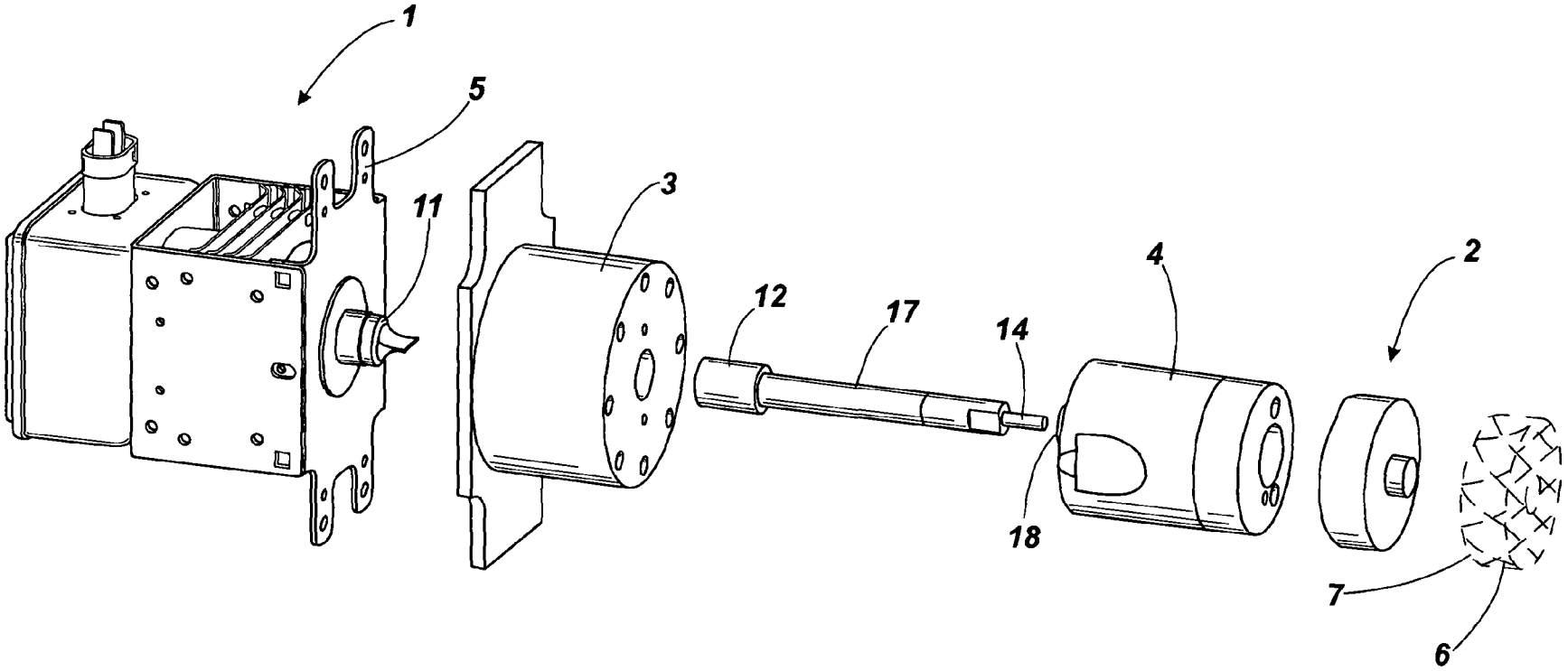
FIG. 1 is an exploded view of a light source according to the invention.
Figure 2:
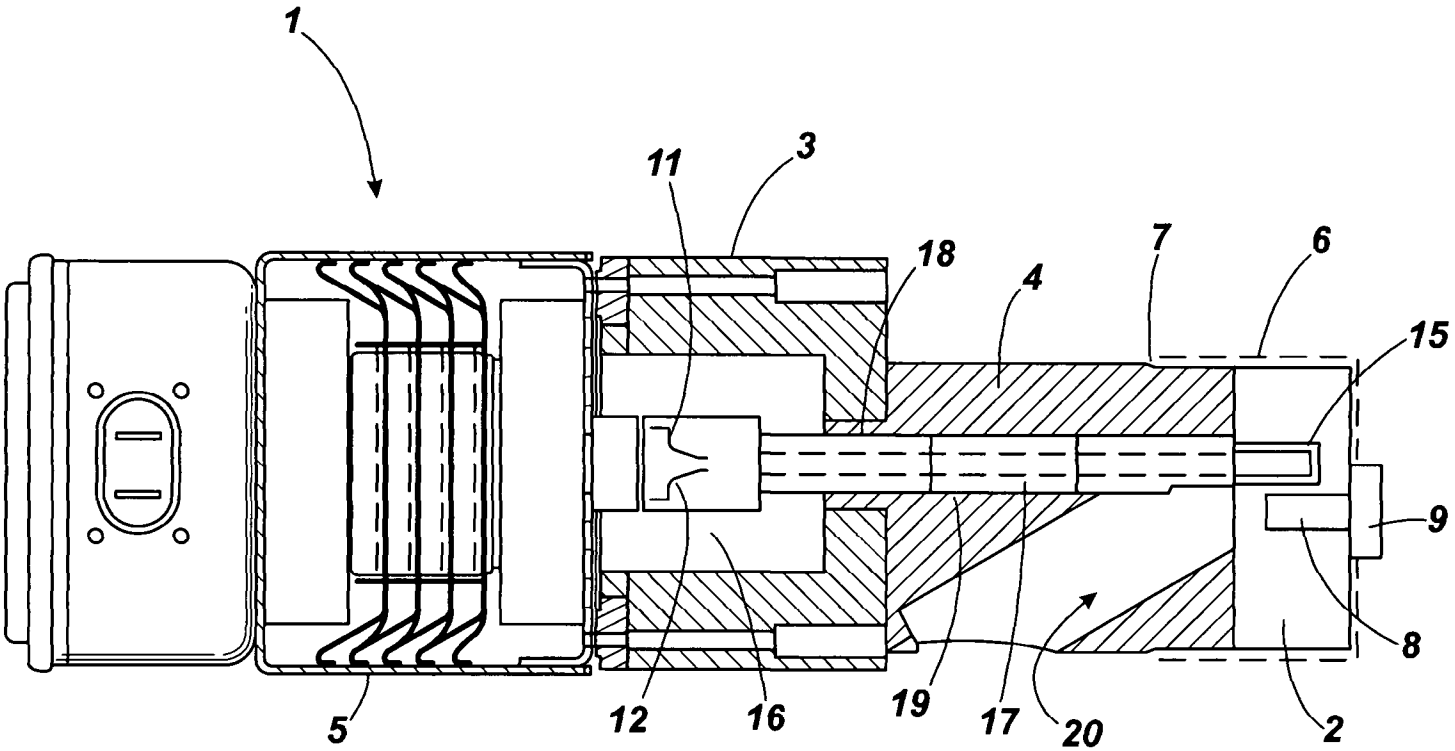
FIG. 2 is a partially centrally-sectioned, view of the light source of FIG. 1.

Referring to the drawings, the light source is powered by a magnetron 1 and has a quartz crucible 2, from which light radiates in use.

Two aluminium attachment blocks 3, 4 are attached together and the block 3 is attached to a casing 5 of the magnetron 1 by screws—not shown. The quartz crucible is attached to the block 4 by a Faraday cage 6, in the form of a perforate metal enclosure secured at its rim 7 to the block 4.

The quartz crucible encloses an excitable fill in a central void 8, closed by an end boss 9.

In accordance with the invention, an output formation 11 of the magnetron has a conductive, copper cap 12 fitted in electrical contact with it. The cap is extended by a copper rod 14. The rod extends through the blocks 3, 4 into a bore 15 in the crucible 2 for coupling microwaves from the magnetron into the crucible.

An airspace 16 is provided around the cap 12 in the block 3. From the cap, the rod extends with negligible air gap in an alumina ceramic tube 17 through the airspace and a boss 18 of the block 4 located in an aperture in an end wall of the block 3.

Figure 3:
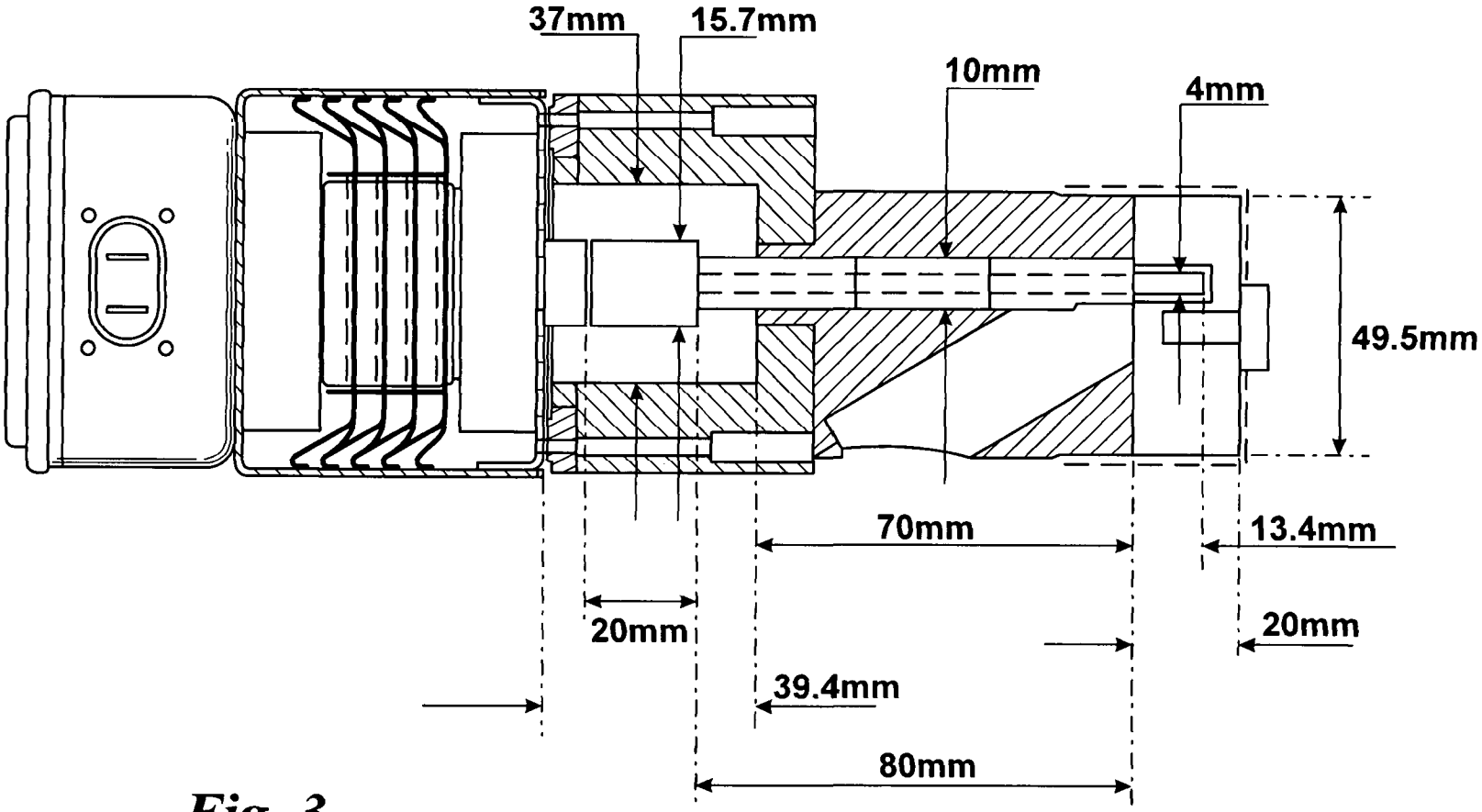
FIG. 3 is a view similar to FIG. 2, showing dimensions of the preferred embodiment.

The components are dimensioned for operation at 2.4 GHz. The dimensions are shown in FIG. 3

In use, microwaves generated in the magnetron propagate along the transmission line formed by the rod 14 in coaxial arrangement inside the blocks, the formation 11, the cap 12, the rod 14, the ceramic tube 17, the airspace 16 and a bore 19, in which the ceramic tube extends with negligible air gap, all being circular in cross-section and concentric. From the distal end of the rod, the microwave radiate into the quartz crucible setting up electromagnetic resonance, with a maximum field strength at the void 8, causing a plasma therein to radiate light. The plasma is initiated by a non-shown starter a bore 20 in the block 4.

The invention claimed is:

1. A light source to be powered by microwave energy, the light source having:

a solid plasma crucible of material which is lucent for exit of light therefrom, the lucent crucible having a sealed void therein; a microwave-enclosing Faraday case surrounding the lucent crucible, the case being at least partially light transmitting for light exit therethrough from the lucent crucible;

a fill in the void of material excitable by microwave energy to form a light emitting plasma therein;

an antenna arranged within the lucent crucible for transmitting plasma-inducing microwave energy to the fill, the antenna having:

a connection extending outside the lucent crucible for coupling to a source of microwave energy;

a generator of microwaves for excitation of a light emitting plasma in the sealed void, the generator having an output for microwaves;

means for attaching the generator to the lucent crucible, the attachment means having:

a passage with a conductive wall extending from the generator output to the antenna connection; and an electrical conductor passing along the passage from the output of the generator to the connection of the antenna, the conductor forming with the conductive passage a transmission line for microwave energy from the generator to the lucent crucible for excitation of the plasma therein.

2. A light source as claimed in claim 1, wherein the generator is adapted to generate microwaves at a frequency to excite resonance within the lucent crucible.

3. A light source as claimed in claim 1, wherein the Faraday cage and a chassis of the microwave generator are electrically connected together by the conductive wall of the passage.

4. A light source as claimed in claim 3, including an earth connection for all of the case, the chassis and the wall.

5. A light source as in claim 3, wherein the conductive wall is a bore in a metallic body connecting the Faraday cage & lucent crucible and the microwave generator.

6. A light source as claimed in claim 5, wherein the electrical conductor is co-axial with the bore, being held in the center of the bore by a spacer.

7. A light source as claimed in claim 6, wherein the spacer is of solid dielectric material.

8. A light source as claimed in claim 7, wherein the solid dielectric material is alumina ceramic.

9. A light source as claimed in claim 1, wherein the electrical conductor is connected to a metallic cap fitted to an output formation of the microwave generator.

10. A light source as claimed in claim 1, wherein the microwave generator is a magnetron.

11. A light source as claimed in claim 2, wherein the Faraday cage and a chassis of the microwave generator are electrically connected together by the conductive wall of the passage.

12. A light source as in claim 4, wherein the conductive wall is a bore in a metallic body connecting the Faraday cage & lucent crucible and the microwave generator.

* * * * *